United States Patent [19]

Enen, Jr. et al.

[11] 4,378,135

[45] Mar. 29, 1983

[54] DRILLING STABILIZER WITH MECHANICALLY ENGAGING AND DISENGAGING SLIPS

[75] Inventors: Jack Enen, Jr.; Alvie Barron, both of Dallas, Tex.

[73] Assignee: Fulbright & Jaworski, Houston, Tex.

[21] Appl. No.: 9,312

[22] Filed: Feb. 5, 1979

[51] Int. Cl.[3] ..... F16C 29/02

[52] U.S. Cl. ..... 308/4 A; 175/325

[58] Field of Search ..... 308/4 A, 4 R, 4 C, 3 R; 166/241; 175/325

[56] References Cited

U.S. PATENT DOCUMENTS

| | | | |
|---|---|---|---|
| 4,101,179 | 7/1978 | Barron | 308/4 A |
| 4,105,262 | 8/1978 | Richey | 308/4 A |
| 4,146,060 | 3/1979 | Garrett | 308/4 A |

*Primary Examiner*—Lenard A. Footland

*Attorney, Agent, or Firm*—Fulbright & Jaworski

[57] ABSTRACT

A rigid drilling stabilizer having outwardly extending ribs is slidably received over a tubular member. A plurality of tapered slip segments are located around the tubular member and within and near each end of the rigid main body of the stabilizer. An end cap is threadedly engagable within each end of the rigid main body. Each slip segment has an inwardly projecting rib and adjacent recess which conform to the corresponding annular recess and rib on the end caps. As an end cap is threadedly engaged to the rigid main body of the stabilizer, the tapered slip segments are urged axially inwardly against a conforming tapered surface within the rigid main body. The slip segments are wedged against the rigid main body and against the tubular member thereby locking the stabilizer to the tubular member. As the end cap is threadedly disengaged from the rigid main body, the slip segments are mechanically disengaged from the rigid main body and the tubular member thereby permitting the stabilizer to be removed or relocated.

1 Claim, 3 Drawing Figures

DRILLING STABILIZER WITH MECHANICALLY ENGAGING AND DISENGAGING SLIPS

BACKGROUND OF THE INVENTION

Oil field drilling operations utilizing a rotary drill string and having a section or sections of drill collar immediately above the drill bit require the application of a drilling stabilizer to the drill collar section or sections in order to minimize the seizure within the drill bore of the drill collar as well as to stabilize the drill string during drilling operations.

It is desired that a drilling stabilizer be quickly connected or disconnected to the drill collar, and that a minimum of manual operations be involved during the connecting or disconnecting of the stabilizer. It is further desirable to employ a drilling stabilizer which can be affixed to the collar section in such a manner that each stabilizer can be affixed at any desired interval from the preceding stabilizer. Those familiar with oil field operations will recognize that the various combinations and spacings of drilling stabilizers are often determinative in obtaining a desired drilling result. It is also advantageous to utilize a drilling stabilizer which is durable throughout a particular drilling operation and which is readily adaptable to any number of dissimilar drill collars utilized in oil field operations around the world.

STATEMENT OF THE PRIOR ART

A drilling stabilizer described in the U.S. Pat. No. 3,916,998 comprises fundamentally a rigid main sleeve having an axial passageway extending therethrough and a rib midway of the passageway against each side of which a pair of slidably received rings abuts. An end cap is threadedly engaged into each end of the rigid main sleeve in such a manner that as the end cap is threaded into the sleeve the inner ring of a pair of rings is forcefully urged into a clamping engagement with the outer surface of the drill collar. Likewise, the outer ring is forced against the inner surface of the main sleeve. Consequently, the device in the U.S. Pat. No. 3,916,998 can be selectively applied to any location on a drilling collar.

A shortcoming of the device in the U.S. Pat. No. 3,916,998, however, has been that once the drilling stabilizer is successfully clamped onto the drill collar, it is frequently difficult to disengage and remove the stabilizer from the collar. Those familiar with drilling operations appreciate that mere removal of the end cap from the rigid main sleeve often does not disengage the outer split ring from the inner split ring on either or both pairs of rings. Consequently, although the end cap has been threadedly disengaged from the rigid main sleeve, the corresponding pair of split rings still exerts a force or forces clamping the stabilizer to the collar. A common practice for disengaging the stabilizer from the collar has been to strike the stabilizer forcefully with any suitable device such as a large hammer. Such an operation clearly requires additional manual effort, tools, time and is also destructive of the stabilizer itself.

A novel drilling stabilizer which solved many of the shortcomings of the stabilizer in the U.S. Pat. No. 3,916,998 is one described in U.S. Pat. No. 4,101,179. The improved stabilizer utilizes a pair of lock rings having corresponding conical surfaces which are forced against an interior abutment within the rigid main sleeve to lock the stabilizer onto the drill collar. The end cap however, has a mechanical interlock to the outer ring such that when the end cap is threadedly disengaged from the rigid main sleeve, the outer ring is slaved to the end cap and is disengaged from the inner lock ring thus disengaging the drilling stabilizer from the drill collar. It is important to note, however, the device as described and claimed in the U.S. Pat. No. 4,101,179 preferably requires a pair of lock rings on either side of an interior abutment means within the rigid main sleeve so that as the outer lock ring of each pair of rings is urged against the inner lock ring, each pair of rings is biased into a locking position. The device nevertheless is easily engaged with and disengaged from a drill collar for application, removal and relocation.

It is to the capability of the device in the 4,101,179 patent to be easily engaged and disengaged that the present device is directed without, however, the use of a pair of lock rings and the inwardly projecting annual rib.

SUMMARY OF THE PRESENT INVENTION

The present invention relates to a drilling stabilizer suitable for receiving a tubular member therethrough, which stabilizer is secured to the tubular member by urging a plurality of tapered slip segments located around the tubular member and inside the rigid main body of the stabilizer against a tapered surface located within the rigid main body. The rigid main body has an axial passageway passing therethrough which has a medially diposed minimum diameter sufficient to receive the tubular member such as, for instance, a drill collar, an outwardly tapered surface on either side of the minimum diameter segment which conforms to the tapered surface of the various slip segments and a threaded outer cylindrical segment at each end of the rigid main body which receives the threaded end cap.

A plurality of tapered slips are disposed on either side of the minimum diameter segment of the passageway within the rigid main body and around the tubular member. Each slip segment has an inwardly projecting rib adjacent to a recess. On the leading edge of the threaded segment of the end cap are an annular rib and a recess which conform closely to the recess and the rib respectively of the slip segments. Accordingly, as the end cap is threadedly engaged into the rigid main body and around the tubular member, the corresponding slip segments are urged axially so that the tapered surface of each slip segment abuts the conforming tapered segment of the passageway inside the rigid main body. When the end cap is tightened sufficiently, the tapered surfaces of the slip segments and the tapered segment of the passageway are forced together sufficiently to secure the rigid main body to the slip segments. The reaction of the slip segments against the tapered segment of the passageway further forces the slip segments radially inwardly against the tubular member. Sufficient tightening of the end cap will, therefore, wedge the slip segments tightly against the tapered segment of the passageway and against the outer surface of the tubular member thereby locking the stabilizer to the tubular member.

Because the slip segments are slaved by a mechanical interlock to the end cap, as the end cap is threadedly disengaged from the rigid main body so are the slip segments withdrawn from their locking engagement with the rigid main body and the tubular member. Hence, by utilizing one end cap at each of the rigid main body in combination with the corresponding slip segments, the stabilizer is easily secured to the tubular member and easily disengaged therefrom with a minimum of time, labor expenditure and equipment and without the use of any lock rings or abutting rib.

It is therefore an object of the present invention to provide a stabilizer suitable to receive a tubular member therein which is easily secured to the tubular member without unduly restricting the flexibility of the tubular member.

A further object of the present invention is to provide a drilling stabilizer which is engaged to a tubular member such as a drill collar by applying a torque to a pair of end caps which threadedly engage the main body of the stabilizer and activate a locking means.

A still further object of the present invention is to provide a drilling stabilizer in which the drilling stabilizer is clampingly affixed to the tubular member by means of a plurality of slip segments.

An even further object of the present invention is to provide a drilling stabilizer which is easily disengaged from the tubular member by applying the appropriate torque to the end caps of the stabilizer in order to disengage the stabilizer from the tubular member to permit the removal or relocation of the stabilizer.

Yet a further object of the present invention is to provide a drilling stabilizer in which a plurality of slip segments are wedged against the rigid main body of the stabilizer and the tubular member in order to lock the stabilizer to the tubular member and in which the slip segments are mechanically interlocked to the end cap so that as the end caps are threadedly disengaged from the rigid main body of the stabilizer, the corresponding slip segments are mechanically disengaged from their locking function.

Further objects and other features and advantages of the present invention will be apparent in the following description of the preferred embodiments of the invention, given for the purpose of disclosure and taken in conjunction with the accompanying drawings.

DESCRIPTION OF THE PREFERRED EMBODIMENTS

Figure 1:
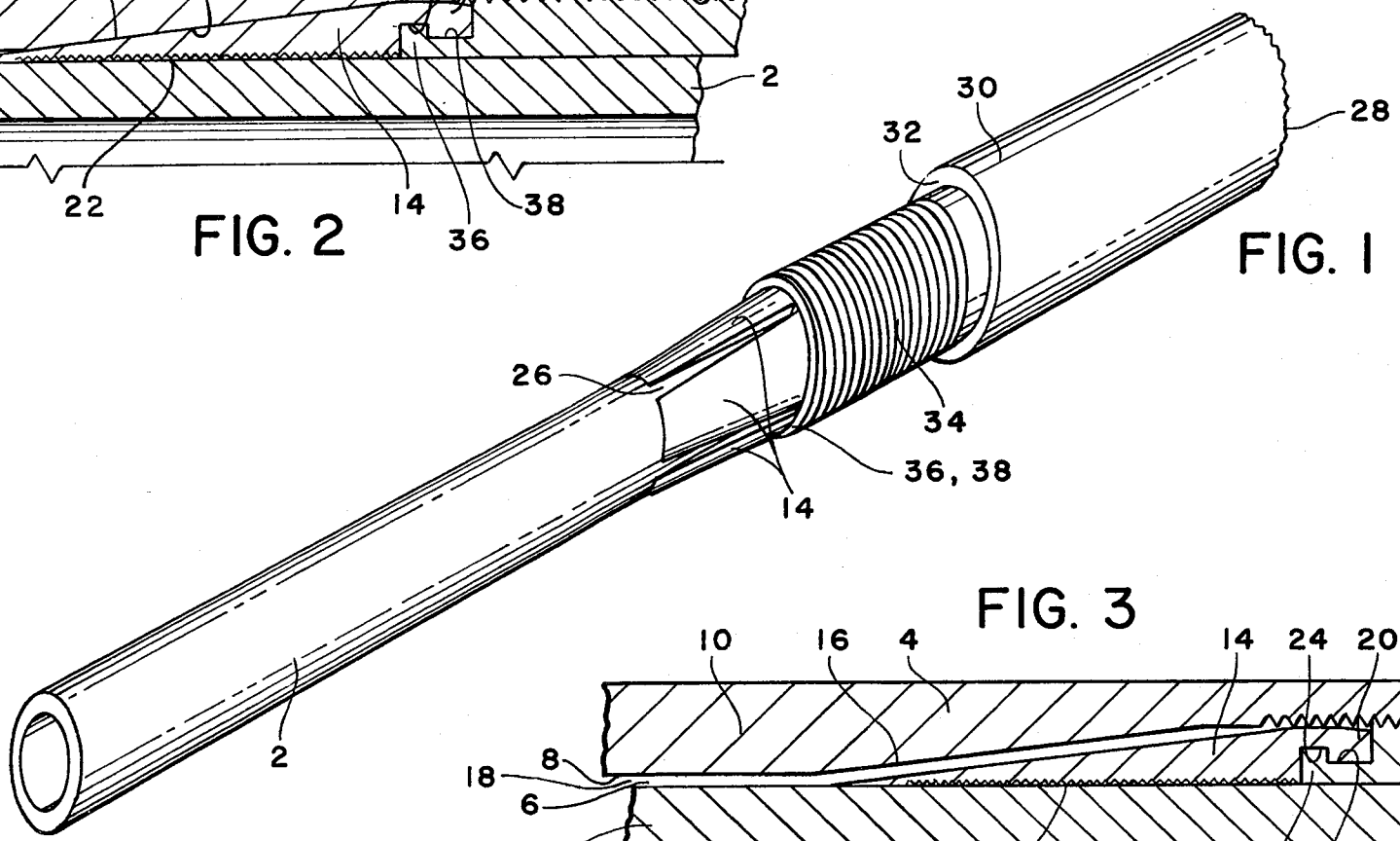
FIG. 1 represents a view in perspective of the threaded end cap interlocked with a plurality of slip segments which are in place around a tubular member.
Figure 2:
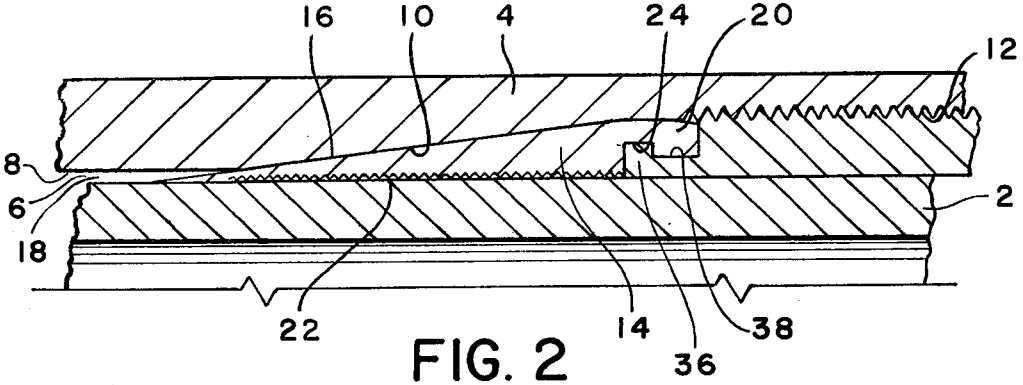
FIG. 2 is a fragmented view in section along the longitudinal axis of the stabilizer and tubular member showing the rigid main body, one slip segment and a portion of the end cap interlocked with the slip segment which is in the engaged position around the tubular member.
Figure 3:
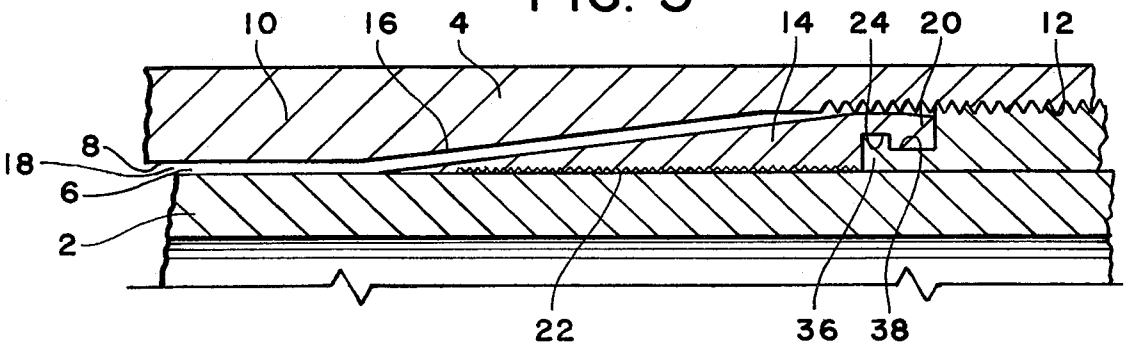
FIG. 3 is a view similar to FIG. 2 showing one slip segment when it is disengaged from the rigid main body and the tubular member.

FIGS. 2 and 3 show in section a portion of a tubular member 2 such as a drill collar. A portion of the rigid main body 4 of the stabilizer having exterior spiraled ribs (not shown) is shown in relation to the tubular member 2. A single arcuate slip segment 14 is shown in section in FIG. 3 in the unlocked position around a portion of the outer surface of the tubular member 2. Those skilled in the art will realize that a single slip segment being less than 360° may suffice to lock the rigid main body 4 to the tubular member 2, but at least two slip segments 14 for each end of the stabilizer are preferred in the present invention to secure a better locking action by the slips 14 to the rigid main body and the tubular member. Each slip segment 14 has a tapered surface 16 which conforms to a corresponding conically shaped tapered segment 10 of the passageway 18 which extends axially throughout the length of the rigid main body 4. Each slip segment 14 further includes a rib 20 which projects radially inwardly less than the arcuate surface 22 of the slip segment 14. A recess 24 is disposed between the rib 20 and the remainder of the slip segment 14. As shown in FIG. 1, the slip segments 14 can be circumferentially separated from one another by a void 26 for ease of manipulation and reduced cost of manufacture while still forming a substantially cylindrical inner surface comprised of the surfaces 22 of the slip segments.

Each slip segment 14 has an arcuate surface 22 which generally conforms to a portion of the outer surface of the tubular member 2 such that when a plurality of slip segments 14 is applied circumferentially around the tubular member 2, the tubular member is substantially encompassed by the slip segments as shown in FIG. 1.

An end cap 28 basically consists of a shoulder portion 30 terminating in a flange 32 and a threaded segment 34 which is compatible with the threaded cylindrical segment 12 of the rigid main body 4. An interlock 36 disposed on the leading end of the end cap 28 as the end cap is engaged into the passageway 18 includes an annular rib 36 and an annular recess 38 which conform to and are compatible with the recesses 24 and ribs 20 respectively of the slip segments 14. A second passageway 40 extends axially through the length of the end cap 28, the second passageway of sufficient diameter to receive the tubular member 2.

In operation, a plurality of slip segments 14 is interlocked to the interlock 36 of the end cap 28, and the tubular member 2 is received by the interlocked slip segments 14 and the end cap 28. The rigid main body 4 also receives through the passageway 18 the tubular member 2. The end cap 28 is threadedly engaged into the rigid main body 4. Sufficient torque is applied to the end cap 28 so that the tapered surface 16 of each slip segment 14 is urged into locking engagement with the tapered segment 10 in the passageway 18 of the rigid main body 4. The unique relationship of the tapered segment 10 and the tapered surface 16 simultaneously causes each slip segment 14 to bear against the outer surface of the tubular member 2 which in turn secures the slip segments 14 to the tubular member. Hence, by applying sufficient torque to the end cap 28, the plurality of slip segments 14 acts as an interlock means between the rigid main body 4 and the tubular member 2. Those skilled in the art will realize that preferably the other end of the rigid main body 4 is similarly secured to the tubular member 2 in order to insure maximum stability and engagement of the stabilizer to the tubular member.

The minimum diameter 8 of the passageway 18 is slightly greater than the diameter of the tubular member 2. Hence, as the slip segments 14 are urged into locking engagement with the rigid main body 4 and the tubular member 2 as shown in FIG. 2, an annular gap 6 remains between the rigid main body 4 and the tubular member 2. Accordingly, the stabilizer is circumferentially secured to the tubular member 2 at the slip segment surfaces 22 and to a degree by the surfaces of the second passageway 40, but the minimum diameter 8 which is disposed between the slip segments 14 at either end of the stabilizer does not bear directly against the surface of the tubular member 2. Thus, a certain degree of flexibility of the tubular member 2 is retained when the stabilizer is applied to the tubular member.

Again in operation, as the end cap 28 is threadedly disengaged from the rigid main body 4, and because the slip segments 14 are mechanically slaved or interlocked to the interlock 36 of the end cap 28, the plurality of slip segments 14 is disengaged from the tapered segment 10 which reduces the force exerted by the slip segments upon the outer surface of the tubular member 2. Accordingly, the locking action of the plurality of slip segments 14 of the rigid main body 4 to the tubular member 2 is terminated. Again, those skilled in the art will realize that as the remaining end cap with the corresponding slip segments 14 is threadedly disengaged from the rigid main body 4, the stabilizer is free to slide along the tubular member 2 permitting the operator to remove or reposition the stabilizer.

In order to increase the gripping capability of the slip segments 14 against the outer surface of the tubular member 2, the surface 22 of the slip segments can be serrated. Moreover, other appropriate techniques known in the industry may be utilized to increase the coefficient of friction of the arcuate surfaces 22 on the tubular member 2.

In oil field operations, therefore, the invention as described and claimed herein is quickly and easily engaged to or disengaged from the drill collar. Moreover, the particular mechanism for engaging the stabilizer to the tubular member 2, for example and not by way of limitation a drill collar, is a plurality of circumferentially arranged arcuate slip segments 14 which are mechanically interlocked or slaved to the end cap 28 which is easily turned either to engage or release the locking effect of the slip segments 14 against the rigid main body 4 and the drill collar. A typical procedure for disengagement requires the slips on a drilling rig (not shown) to be set below the stabilizer. The end cap 28 upper in relation to the remaining end cap of the stabilizer is "broken out" or threadedly disengaged from the rigid main body 4 with, for example, a tong (not shown). The tubular member 2 such as a drill collar is then raised through the slips and set at a level appropriate for the lower end cap (not shown) to be broken out from the rigid main body 4. Before the lower end cap is broken out from the rigid main body 4, it is desirable to support the drilling stabilizer, for example, by an air hoist line or cat line (not shown). The final step is to break out the lower end cap from the rigid main body 4. As the lower end cap is threadedly disengaged from the rigid main body 4, the clamping forces affixing the stabilizer to the drill collar have been reduced and the stabilizer is now free to slide on the collar. For reasons of safety, the air hoist line or cat line should be attached to the stabilizer prior to breaking out the lower end cap in order to support the stabilizer as it becomes free to slide on the collar.

It is therefore clear that the present invention is a new and useful design for a drilling stabilizer which is both suitable for downhole use in the oil field while at the same time fulfilling all the objectives as expressed previously herein. The preferred embodiments of the present invention have been given for the purpose of disclosure, and changes may be made which are in the spirit and the scope of the invention as defined by the claims, specifications and drawings herein.

What is claimed is:

1. A drilling stabilizer suitable for use with a tubular member comprising (a) a substantially cylindrical rigid main body having two ends and further including:
  (i) a passageway extending axially through the length of the rigid main body, the minimum diameter of said passageway being disposed substantially medially within the rigid main body and sufficient to permit the tubular member to be received therethrough,
  (ii) a threaded cylindrical segment of the passageway at each end thereof, said cylindrical segment having a greater diameter than the minimum diameter of the passageway (b),
  (iii) a tapered segment connecting each cylindrical segment (ii) with the minimum diameter (i), (b) a plurality of slip segments, each slip segment including,
  (i) a tapered surface substantially conforming to the tapered segment of the rigid main body,
  (ii) an annular rib,
  (iii) an annular recess disposed between the annular rib and the remainder of the slip segment, and
  (iv) an inner arcuate surface substantially conforming to the outer surface of the tubular member, at least one inner arcuate surface of said slip segments being serrated, (c) an end cap including,
  (i) a substantially cylindrical shoulder portion,
  (ii) a substantially cylindrical threaded cylindrical segment, engageable within the threaded cylindrical segment of the passageway and terminating at one end in a flange disposed between the shoulder portion and threaded segment, and at the other end in an annular rib and an annular recess which are compatible with the annular recess and annular rib respectively of each slip segment whereby as the end cap is threadedly engaged into the rigid main body, the end cap urges the tapered surfaces of the slip segments into abutting engagement with the corresponding tapered segment of the passageway, thereby urging the inner arcuate surfaces of the slip segments into abutting engagement with the tubular member to lock the stabilizer onto said tubular member and whereby as the end cap is threadedly disengaged from the rigid main body, the slip segments are disengaged from their abutment with the tapered segment thereby unlocking the stabilizer from the tubular member.

* * * * *

UNITED STATES PATENT OFFICE

CERTIFICATE OF CORRECTION

Patent No. 4,378,135 Dated March 29, 1983

Inventor(s) Jack Enen, Jr.; Alvie Barron

It is certified that error appears in the above-identified patent and that said Letters Patent are hereby corrected as shown below:

Front page, item 73 change assignee -

Delete "Fulbright & Jaworski, Houston, Tex."

Insert "Royal Tool Company Dallas, Tex."

Signed and Sealed this

Twenty-fourth Day of July 1984

[SEAL]

Attest:

GERALD J. MOSSINGHOFF

Attesting Officer

Commissioner of Patents and Trademarks